US007043349B2

(12) United States Patent
Cullen

(10) Patent No.: US 7,043,349 B2
(45) Date of Patent: May 9, 2006

(54) METHOD AND SYSTEM FOR INFERRING EXHAUST TEMPERATURE OF A VARIABLE COMPRESSION RATIO ENGINE

(75) Inventor: Michael John Cullen, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 21 days.

(21) Appl. No.: 10/063,461

(22) Filed: Apr. 25, 2002

(65) Prior Publication Data

US 2003/0204305 A1 Oct. 30, 2003

(51) Int. Cl.

| | |
|---|---|
| ***G06G 19/00*** | (2006.01) |
| ***F02M 25/07*** | (2006.01) |
| ***F02D 41/04*** | (2006.01) |
| ***F02B 75/04*** | (2006.01) |

(52) U.S. Cl. ..... 701/103; 701/108; 123/676; 123/568.14; 123/78 E; 123/78 F

(58) Field of Classification Search ..... 123/48 R, 123/48 A, 48 AA, 48 B, 48 C, 48 D, 78 R, 123/78 A, 78 AA, 78 B, 78 BA, 78 C, 78 D, 123/78 E, 78 F, 316, 568.11, 568.13, 568.14, 123/90.15–90.17, 435, 436, 478, 480, 676; 60/602, 605.2; 701/101–104, 108, 114, 115
See application file for complete search history.

(56) References Cited

U.S. PATENT DOCUMENTS

| | | | | |
|---|---|---|---|---|
| 4,469,055 | A | 9/1984 | Caswell | 123/78 B |
| 4,805,571 | A | 2/1989 | Humphrey | 123/316 |
| 4,834,031 | A | 5/1989 | Katoh et al. | 123/48 R |
| 4,860,711 | A | 8/1989 | Morikawa | 123/48 D |
| 5,165,368 | A | 11/1992 | Schechter | 123/48 B |
| 5,255,637 | A | 10/1993 | Schechter | 123/48 R |
| 5,287,827 | A | 2/1994 | Almendinger et al. | 123/46 R |
| 5,595,146 | A | 1/1997 | Bollig et al. | 123/48 B |
| 5,682,854 | A | 11/1997 | Ozawa | 123/316 |
| 5,791,302 | A | 8/1998 | Ma | 123/48 B |
| 5,819,702 | A | 10/1998 | Mendler | 123/311 |
| 5,862,790 | A | 1/1999 | Dai et al. | 123/316 |
| 6,067,800 | A * | 5/2000 | Kolmanovsky et al. | 60/602 |
| 6,125,801 | A | 10/2000 | Mendler | 123/48 R |
| 6,427,643 | B1 * | 8/2002 | Dixon | 123/48 A |
| 6,508,241 | B1 * | 1/2003 | Miller et al. | 123/436 |
| 6,508,242 | B1 * | 1/2003 | Jaliwala et al. | 123/676 |
| 6,516,757 | B1 * | 2/2003 | Aoyama et al. | 123/78 R |
| 6,550,464 | B1 * | 4/2003 | Brackney | 123/676 |
| 2002/0092488 | A1 * | 7/2002 | Aoyama et al. | 123/90.16 |

* cited by examiner

*Primary Examiner*—Willis R. Wolfe, Jr.
(74) *Attorney, Agent, or Firm*—Allan J. Lippa; Alleman Hall McCoy Russell & Tuttle LLP

(57) ABSTRACT

A method for operating a variable compression ratio internal combustion engine includes the steps of determining a compression ratio operating state of the engine and inferring an exhaust temperature for the engine based at least in part on the compression ratio operating state of the engine.

14 Claims, 3 Drawing Sheets

START
302
DETERMINE ENGINE SPEED
304
DETERMINE AIRCHARGE
306
DETERMINE EGR RATE
308
DETERMINE SPARK TIMING
310
DETERMINE ENGINE COOLANT TEMP
312
DETERMINE CR STATE
314
HIGH_CR = TRUE ?
YES
NO
316
BASELINE EXHAUST TEMP
318
MODIFIED EXHAUST TEMP
END

METHOD AND SYSTEM FOR INFERRING EXHAUST TEMPERATURE OF A VARIABLE COMPRESSION RATIO ENGINE

BACKGROUND OF INVENTION

1. Field of the Invention

The present invention relates generally to variable compression ratio internal combustion engines. More particularly, the invention relates to a method and system for determining the exhaust temperature of a variable compression ratio internal combustion engine.

2. Background Art

The "compression ratio" of an internal combustion engine is defined as the ratio of the cylinder volume when the piston is at bottom-dead-center (BDC) to the cylinder volume when the piston is at top-dead-center (TDC). Generally, the higher the compression ratio, the higher the thermal efficiency and fuel economy of the internal combustion engine. So-called "variable compression ratio" internal combustion engines have been developed, for example, having higher compression ratios during low load conditions and lower compression ratios during high load conditions. Various techniques have been disclosed for varying compression ratio, including for example, using "sub-chambers and "sub-pistons" to vary the volume of a cylinder, see for example patents U.S. Pat. No. 4,246,873 and U.S. Pat. No. 4,286,552; varying the actual dimensions of all or a portion of a piston attached to a fixed length connecting rod, see U.S. Pat. No. 5,865,092; varying the actual length of the connecting rod itself, see U.S. Pat. No. 5,724,863 and U.S. Pat. No. 5,146,879; and using eccentric rings or bushings either at the lower "large" end of a connecting rod or the upper "small" end of the connecting rod for varying the length of the connecting rod or height of the reciprocating piston. See U.S. Pat. No. 5,562,068, U.S. Pat. No. 5,960,750, U.S. Pat. No. 5,417,185 and Japanese Publication JP-03092552.

As with conventional internal combustion engines, it is vitally important for a number of reasons to be able to accurately estimate the exhaust temperature of a variable compression ratio internal combustion engine. Temperature estimates are used, for example, to limit or otherwise control catalyst or NOx trap temperature.

The inventor herein has recognized the need to accurately determine the exhaust temperature as a function of a selected engine compression ratio in order to ensure optimal control and performance of the engine and the vehicle's aftertreatment system.

SUMMARY OF INVENTION

A method is provided for operating a variable compression ratio internal combustion engine. The method includes the steps of determining a compression ratio operating state of the variable compression ratio internal combustion engine, and inferring the engine's exhaust temperature based at least in part on the compression ratio operating state of the engine. For example, in accordance with the present invention, baseline exhaust temperature can be inferred with a baseline lookup table by determining and entering engine speed, air flow, EGR rate, spark timing, coolant temperature, and current compression ratio operating state of the engine. If the compression ratio is subsequently changed, a new value for exhaust temperature may be extracted from a second lookup table using the same inputs, with the exception of compression ratio, as were used with the first table.

Alternatively, one or more scalar values may be applied to the appropriate value extracted from the baseline lookup table.

Advantageously, the methods described herein allow for improved estimates of engine exhaust temperature that can be used to optimize scheduling of compression ratio operating states in a variable compression ratio internal combustion engine. The methods disclosed herein are useful for optimizing the fuel economy benefits of the engine, while at the same time improving control and performance of a corresponding motor vehicle and related aftertreatment systems.

In accordance with a related aspect of the present invention, a corresponding system is provided for operating a variable compression ratio internal combustion engine. The system includes a compression ratio setting apparatus for configuring the engine in selected ones of the compression ratio operating states, and a controller in communication with the sensors and the compression ratio apparatus, the controller comprising computer program means for inferring exhaust temperature based at least in part on the compression ratio operating state of the engine. A system in accordance with a preferred embodiment further comprises a sensor coupled to the engine for generating a signal representative of engine speed, a sensor coupled to the engine for generating a signal representative of air flow into the engine; and computer program code and look-up tables for determining at least one predefined exhaust temperature based at least upon on the engine speed, the air flow and the compression ratio operating state of the engine.

Further advantages, as well as objects and features of the invention will become apparent from the following detailed description of the invention taken in conjunction with the accompanying figures showing illustrative embodiments of the invention.

BRIEF DESCRIPTION OF DRAWINGS

For a complete understanding of the present invention and the advantages thereof, reference is now made to the following description taken in conjunction with the accompanying drawings in which like reference numerals indicate like features wherein.

DETAILED DESCRIPTION

Figure 1:
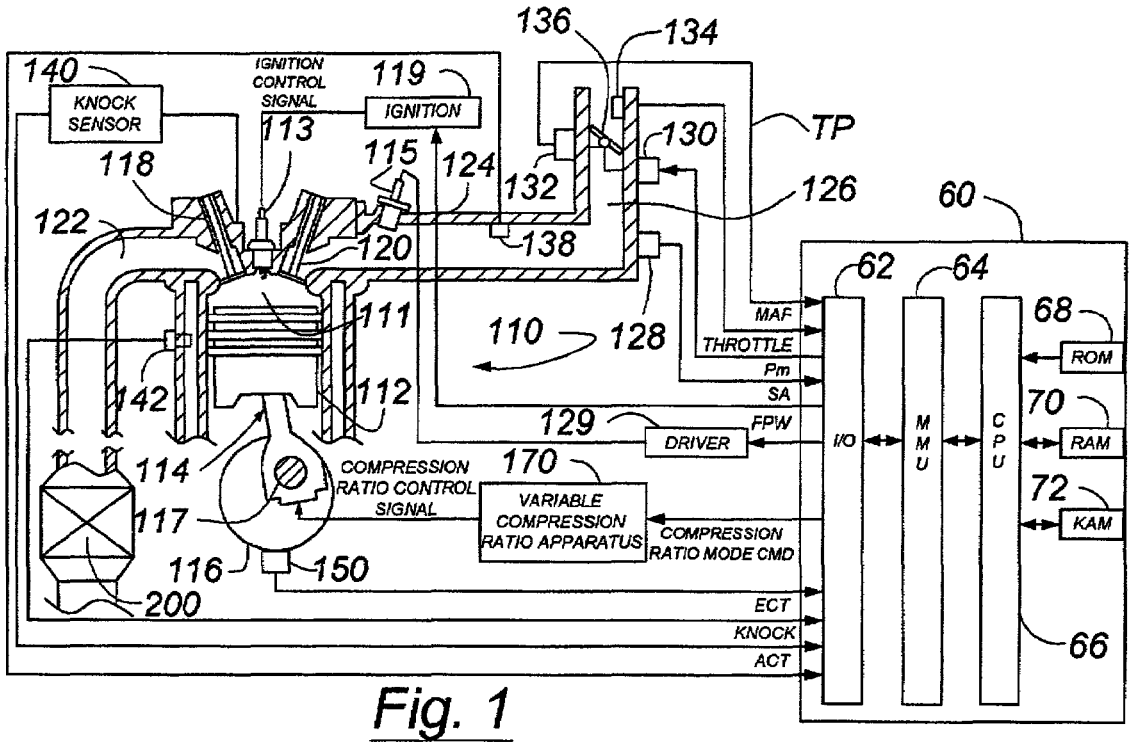
FIG. 1 is a diagram of an exemplary variable compression ratio internal combustion engine in accordance with the present invention.

FIG. 1 shows an exemplary variable compression ratio internal combustion engine in accordance with the present invention. As will be appreciated by those skilled in the art in view of this disclosure, the present invention is independent of the particular underlying engine configuration and component designs, and as such can be used with a variety of different internal combustion engines having more than one compression ratio operating modes. The engine for example can be constructed and operated as a discrete compression ratio engine operating for example at a high compression or at low compression, or as a continuously variable compression ratio engine capable of operating at any number of discrete or selected compression ratios. Similarly, the present invention is not limited to any particular type of apparatus or method required for setting or varying the compression ratio of the internal combustion engine.

Referring again to FIG. 1, engine 110 includes a plurality of cylinders (only one shown), each having a combustion chamber 111, a reciprocating piston 112, and intake and exhaust valves 120 and 118 for communicating the combustion chamber 111 with intake and exhaust manifolds 124 and 122. The piston 112 is coupled to a connecting rod 114, which itself is coupled to a crankpin 117 of a crankshaft 116. Fuel is provided to the combustion chamber 111 via a fuel injector 115 and is delivered in proportion to a fuel pulse width (FPW) determined by an electronic engine or vehicle controller 60 (or equivalent microprocessor-based controller) and electronic driver circuit 129. Air charge into the intake manifold 124 is nominally provided via an electronically controlled throttle plate 136 disposed within throttle body 126. Ignition spark is provided to the combustion chamber 111 via spark plug 113 and ignition system 119 in accordance with a spark advance (or retard) signal (SA) from the electronic controller 60. Exhaust gases pass from the engine into aftertreatment device 200, which may comprise either a conventional oxidizing catalyst, or a conventional three-way catalyst, or a thermal reactor, or any other type of device known to those skilled in the art and suggested by this disclosure.

As shown in FIG. 1, the controller 60 nominally includes a microprocessor or central processing unit (CPU) 66 in communication with computer readable storage devices 68, 70 and 72 via memory management unit (MMU) 64. The MMU 64 communicates data (including executable code instructions) to and from the CPU 66 and among the computer readable storage devices, which for example may include read-only memory (ROM) 68, random-access memory (RAM) 70, keep-alive memory (KAM) 72 and other memory devices required for volatile or non-volatile data storage. The computer readable storage devices may be implemented using any known memory devices such as programmable read-only memory (PROM's), electrically programmable read-only memory (EPROM's), electrically erasable PROM (EEPROM's), flash memory, or any other electrical, magnetic, optical or combination memory devices capable of storing data, including executable code, used by the CPU 66 for controlling the internal combustion engine and/or motor vehicle containing internal combustion engine 110. Input/output (I/O) interface 62 is provided for communicating with various sensors, actuators and control circuits, including but not limited to the devices shown in FIG. 1. These devices include an engine speed sensor 150, electronic fuel control driver 129, ignition system 119, manifold absolute pressure sensor (MAP) 128, mass air flow sensor (MAF, "airmeter") 134, throttle position sensor 132, electronic throttle control motor 130, inlet air temperature sensor 138, engine knock sensor 140, and engine coolant temperature 142.

The engine 110 of FIG. 1 also includes a variable compression ratio ("compression ratio setting") apparatus 170. In a non-limiting embodiment, the variable compression ratio apparatus 170 is operated to vary the effective length of the connecting rod 114, and thus the clearance volume and compression ratio of the engine. Such an apparatus is described, for example, in U.S. application Ser. No. 09/682,263, entitled "Connecting Rod for a Variable Compression Engine," which is owned by the assignee of the present invention and is hereby incorporated by reference in its entirety. The actual construction and configuration of the variable compression apparatus shown in FIG. 1 is not at all intended to limit the scope of claim protection for the inventions described herein.

In a non-limiting aspect of the present invention, the variable compression ratio apparatus of FIG. 1 is described below as operating in a "high" compression ratio mode (compression ratio of 13:1 and above) or a "low" compression ratio mode (compression ratio of 11:1 and below).

Figure 2:
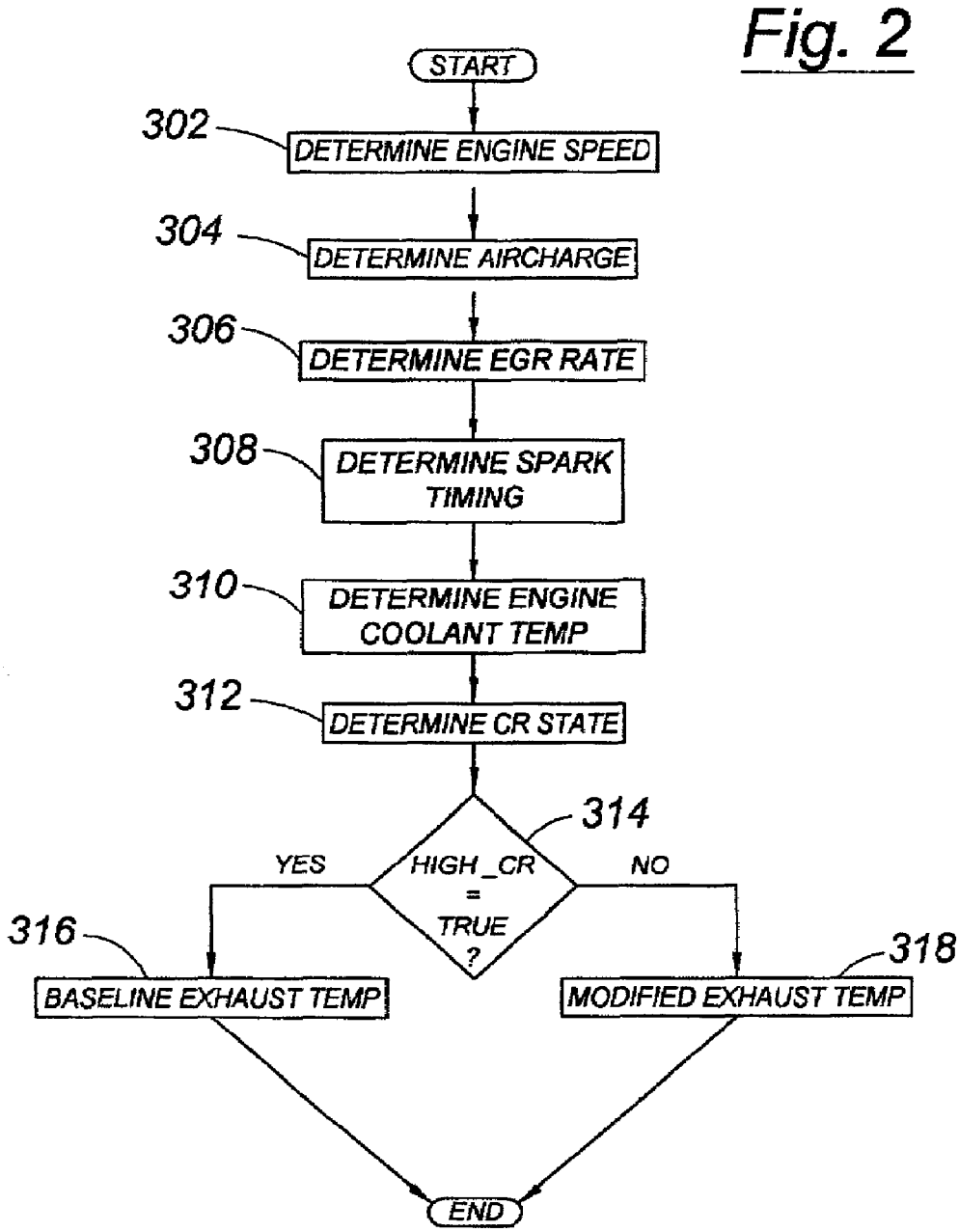
FIG. 2 is a flow diagram of a preferred method for operating a discretely variable compression ratio internal combustion engine in accordance with the present invention.
Figure 3:
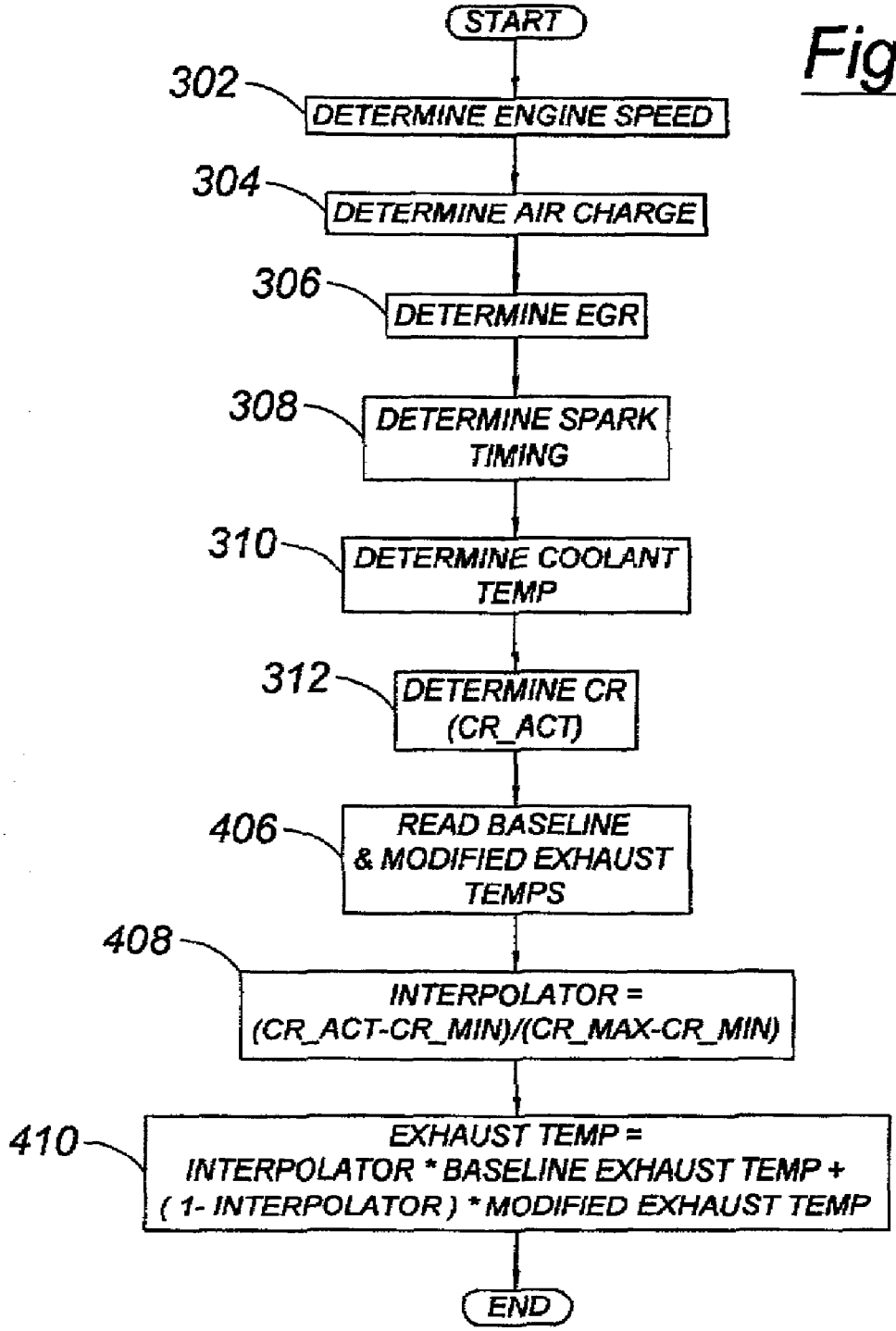
FIG. 3 is a flow diagram of a preferred method for operating a continuously variable compression ratio internal combustion engine in accordance with the present invention.

FIGS. 2 and 3 show flow diagrams of preferred methods for operating a variable compression ratio internal combustion engine in accordance with the present invention. The method of FIG. 2 is applicable to variable compression ratio internal combustion engines operating in discrete compression ratio states, for example the engine described above with reference to FIG. 1, and the method of FIG. 3 is applicable to a continuously variable compression ratio internal combustion engine having for example "HIGH" and "LOW" states representing minimum and maximum limits on a continuous range of compression ratio states. The scope of the present invention however is not intended to be limited to a particular type of engine or compression ratio setting apparatus.

Referring now to FIG. 2, a preferred method for operating a discretely variable compression ratio internal combustion engine includes the steps of determining the rotational speed (RPM or engine_speed) of the engine, step 302, determining the air flow (aircharge) into the engine, step 304, determining the exhaust gas recirculation (EGR) rate, step 306, determining the spark timing of the engine, step 308, and determining engine coolant temperature, step 310. At step 312, the compression ration operating state of the engine is determined.

Those skilled in the art will appreciate in view of this disclosure that a variety of hardware and software schemes may be employed to determine the values of the various engine operating parameters needed to operate a system and method according to the present invention. For example, engine_speed can be determined using a speed sensor coupled to an engine crankshaft, or by using any other method known in the art. Aircharge is also determined using any known method, including for example using a MAF sensor disposed in the engine intake manifold as shown at 132 in FIG. 1. EGR rate may be inferred from EGR valve position and other engine operating parameters. Spark timing is known from the output of controller 60. The compression ratio operating mode can be determined using any of the known methods, including using a combustion pressure sensor disposed in one or more of the cylinders, or by using a piston position sensor or other sensor coupled to the engine and/or the compression ratio setting apparatus of the engine. The compression ratio operating state can also be derived or inferred using any suitable method known to those skilled in the art and suggested by this disclosure.

If the engine is operating in a high compression mode (High_CR=TRUE), step 314, then a baseline exhaust temperature is selected from a baseline lookup table, using as inputs the engine operating parameters previously described. U.S. Pat. No. 5,424,994, which is assigned to the assignee of the present invention, and which is hereby incorporated by reference herein, illustrates one method for using engine operating parameters to determine exhaust temperature for an engine having a fixed compression ratio.

Referring again to FIG. 2, step 314, if the engine is operating in a low compression operating state (High_CR=FALSE), then the routine moves to step 318, wherein a modified exhaust temperature is selected from a second or modified lookup table corresponding to the lower compression ratio. This table is entered using the same operating parameters as the baseline table, with the exception being the compression ratio. These operating parameters may include the parameters shown in steps 302–310, as well as step 312 of FIG. 2.

FIG. 3 shows a preferred method for operating a continuously variable compression ratio internal combustion engine in accordance with the present invention. In accordance with FIG. 3, at step 406, both baseline and modified exhaust temperatures are read, for the conditions listed in steps 302–310. Then, at step 408, an interpolator value is determined in accordance with Equation (1):

$$\text{INTERPOLATOR}=(CR_\text{ACT}\ CR_\text{MIN})/(CR_\text{MAX}\ CR_\text{MIN}) \quad \text{Eq. (1),}$$

wherein CR_ACT is the actual compression ratio of the internal combustion engine, CR_MIN is a minimum compression ratio, and CR_MAX is a maximum compression ratio of the engine. At step 410, the exhaust temperature is determined according to Equation (2):

$$\text{EXHAUST TEMP}=\text{INTERPOLATOR}*\text{BASELINE EXHAUST TEMP}+(1-\text{INTERPOLATOR})*\text{MODIFIED EXHAUST TEMP} \quad \text{Eq.(2).}$$

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

The invention claimed is:

1. A system, method for operating an engine, comprising:

varying compression ratio of the engine with variation of engine operating states during engine operation;

determining at least one of an operating speed of the engine, an air flow of the engine, and an EGR flow of the engine;

determining spark timing of the engine; and determining an exhaust temperature of exhaust gasses produced in the engine, where said determined exhaust gas temperature takes into account said variation in the compression ratio of the engine during engine operation, said at least one of engine speed, air flow, and EGR flow, and said spark timing.

2. A system for operating an internal combustion engine having a plurality of compression ratio operating states, the system comprising:

an apparatus configured to vary the compression ratio of the engine among said plurality of the compression ratio operating states during engine operation, the apparatus varying the actual compression ratio of the engine; and a controller for determining an exhaust temperature of exhaust gasses produced in the engine, where said determined exhaust gas temperature takes into account said variation in the compression ratio of the engine during engine operation and at least one engine operating parameter.

3. The system of claim 2 wherein said at least one engine operating parameter is engine speed.

4. The system of claim 2 wherein said at least one engine operating parameter is spark timing.

5. The system of claim 2 wherein said at least one engine operating parameter is engine coolant temperature.

6. The system of claim 2 wherein said at least one engine operating parameter is an EGR amount.

7. The system of claim 2 wherein said at least one engine operating parameter is an air amount.

8. The system of claim 2 wherein said controller determines said exhaust temperature of exhaust gasses by taking into account said variation in the compression ratio of the engine, engine coolant temperature, an air amount, and spark timing.

9. A method for operating an engine, comprising:

varying compression ratio of the engine with variation of engine operating states during engine operation, where the engine has a variable compression ratio apparatus, the apparatus varying the actual compression ratio of the engine;

determining an exhaust temperature of exhaust gasses produced in the engine, where said determined exhaust gas temperature takes into account said variation in the compression ratio of the engine during engine operation.

10. A method according to claim 9, further comprising:

determining an operating speed of the engine;

determining an air flow of the engine;

determining the EGR flow through the engine; and further determining engine exhaust temperature in response to the engine speed, the air flow, and the EGR flow.

11. A method according to claim 10, wherein said engine exhaust temperature is further determined in response to spark timing of the engine.

12. A method according to claim 10, wherein said engine exhaust temperature is further determined in response coolant temperature.

13. A method according to claim 10, wherein exhaust temperature is selected from a baseline lookup table if the engine is operating at a higher compression ratio, with said exhaust temperature being selected from a modified table in the event that the engine is being operated at a lower compression ratio.

14. A method according to claim 10, wherein exhaust temperature is interpolated between a first temperature value drawn from a baseline lookup table applicable if the engine is operating at a predetermined higher compression ratio and a second temperature drawn from a modified lookup table applicable if the engine is running at a predetermined lower compression ratio, with said interpolation being further based upon the actual compression ratio at which the engine is operating.

* * * * *